United States Patent [19]

Lister

[11] 4,151,889

[45] May 1, 1979

[54] ROCK-DRILLING BIT FOR PERCUSSION HAMMERS

[76] Inventor: William Lister, 36 Rabaul St., Moorooka, Queensland 4105, Australia

[21] Appl. No.: 811,262

[22] Filed: Jun. 29, 1977

[30] Foreign Application Priority Data

Jul. 13, 1976 [AU] Australia ..... 6621/76

[51] Int. Cl.[2] ..... E21C 13/00

[52] U.S. Cl. ..... 175/410; 175/92; 173/32

[58] Field of Search ..... 175/410, 92, 321, 105, 175/103, 389; 173/128–133, 73, 78, 80

[56] References Cited

U.S. PATENT DOCUMENTS

| | | | |
|---|---|---|---|
| 1,136,545 | 4/1915 | MacDonald | 175/410 |
| 3,059,619 | 10/1962 | Beaumont | 175/92 X |
| 3,269,470 | 8/1966 | Kelly, Jr. | 175/410 |
| 3,618,683 | 11/1971 | Hughes | 175/410 |
| 3,693,736 | 9/1972 | Gardner | 175/410 |
| 3,735,820 | 5/1973 | Curington | 173/133 X |
| 3,771,612 | 11/1973 | Adcock | 175/410 X |
| 3,952,819 | 4/1976 | Adcock | 175/410 X |

FOREIGN PATENT DOCUMENTS

| | | | |
|---|---|---|---|
| 1514998 | 1/1968 | France | 175/410 |

*Primary Examiner*—Ernest R. Purser
*Assistant Examiner*—Richard E. Favreau
*Attorney, Agent, or Firm*—Donald D. Jeffery

[57] ABSTRACT

A rock drilling bit for a pneumatic percussion hammer has a bit head and an anvil extending up from the bit head and slidable in the bit drive sub of the hammer. So the bit will be rotated with the hammer without unduly stressing the anvil, the upper part of the bit head is of non-round cross-section and slidable in a socket of corresponding cross-section in the bit drive sub. If the anvil is not integral with the bit head, but is screwed into it, the lower part of the anvil is of matching non-round cross-section so torque applied by the rotating hammer is applied equally to anvil and bit head.

5 Claims, 5 Drawing Figures

ROCK-DRILLING BIT FOR PERCUSSION HAMMERS

BACKGROUND OF THE INVENTION

This invention relates to a rock drilling bit for a pneumatic percussion hammer.

A pneumatic percussion hammer for rock drilling normally includes a tubular housing having at its upper end a top drive sub for connection to a tubular drill rod through which air may be conducted under pressure, and having a bottom or bit drive sub in which there is engaged, with limited slidable movement, an anvil, extending upwardly from a bit head which, with the anvil, constitutes a rock drilling bit. The bit head is located below the bit drive sub, and it has a number of tungsten carbide buttons protruding from its bottom. When the hammer is in operation, the anvil is struck at high frequency by a piston reciprocated pneumatically within the housing, and at the same time the hammer is rotated, rotating the bit, the anvil of which is in splined engagement with the interior of the housing.

As the bit head is rotated at the same time as the anvil is being struck at high frequency by the piston, the torsional stress on the anvil, splined to the housing, is likely to contribute very materially to failure of the anvil. Such breakages occur fairly frequently in rock drilling pneumatic hammers, and the replacement of the rock drilling bits is very costly and time consuming. Another disadvantage of bits hitherto made is that tungsten carbide buttons are likely to be sheared off after the bit has been used for a fairly short time.

If the anvil is made separately from the bit head, having its lower end screwed into the bit head, the high frequency blows of the piston on the anvil, and the torque acting on the housing, transmitted to the anvil and to which the bit head offers resistance, may result in such stresses in the bit head that the bit head will shatter.

The present invention has been devised with the general object of providing a bit of the general type described, which is particularly sturdy, durable and trouble-free in operation.

SUMMARY OF THE INVENTION

The present invention resides broadly in a percussion hammer rock drilling bit of the type having a bit head, and an anvil extending upwardly from the bit head and slidable in a bit drive sub at the lower end of the hammer, wherein the upper part of the bit head is of non-round cross-section, adapted for slidable but non-rotational movement in a socket in the lower part of the bit drive sub. Preferably the anvil and the bit head are two members coaxially interconnected, and the superimposed lower part of the anvil and upper part of the bit head are of matching non-round cross-section, preferably of regular polygonal form, the two superimposed parts being closely slidable in the socket of the bit drive sub, which is of corresponding cross-sectional configuration, so that torque applied to the housing is transferred equally to the anvil and the bit head.

BRIEF DESCRIPTION OF THE DRAWINGS

A preferred embodiment of the invention is shown in the accompanying drawings, wherein.

DESCRIPTION OF THE PREFERRED EMBODIMENT

Figure 1:
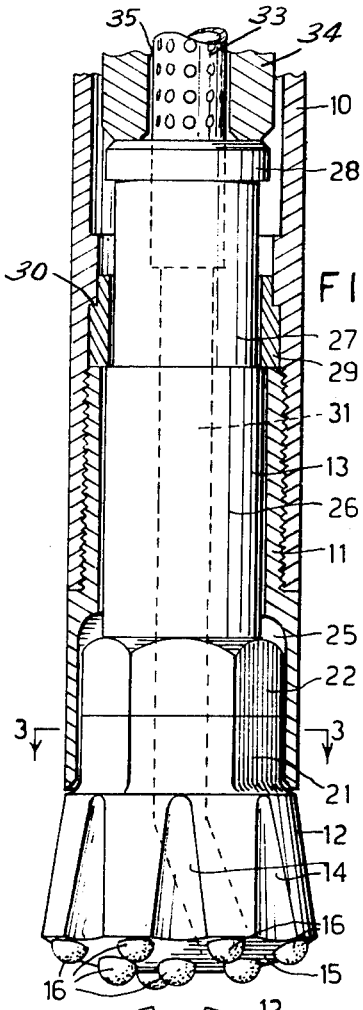
FIG. 1 is a partly sectional view of the lower part of a pneumatic percussion hammer incorporating a rock drilling bit according to the invention.
Figure 2:
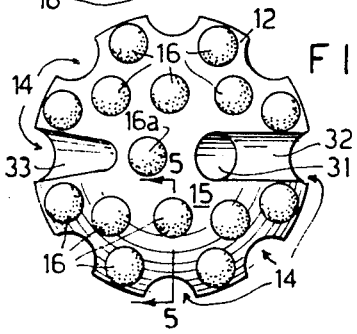
FIG. 2 is a bottom view of the bit shown in FIG. 1.
Figure 3:
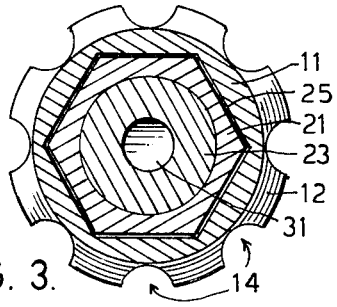
FIG. 3 is a sectional view along line 3—3 in FIG. 1.

The pneumatic hammer, of which the lower part is illustrated, may be substantially as described in the specification of my co-pending Patent Application No. 701181 filed June 30, 1976, now U.S. Pat. No. 4,084,647, granted Apr. 18, 1978.

The hammer has a tubular housing 10, of which the lower part is internally threaded and has screwed into it the threaded upper part of a bit drive sub 11.

A rock drilling bit is reciprocally slidable in the bit drive sub 11, and includes a bit head 12, and an anvil 13.

The main lower part of the bit head 12 is a substantially frusto-conical member with a series of equally spaced vertical flutes 14 formed in its periphery, and with a convex bottom 15.

Figure 5:
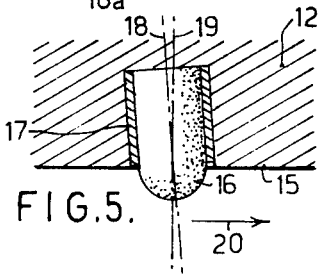
FIG. 5 is a sectional detail drawing, to larger scale, along line 5—5 in FIG. 2.

A number of similar tungsten carbide buttons 16 are secured in holes formed in the bottom 15 of the bit head, each of these buttons, as shown in FIG. 5, being in the form of a cylinder with a hemispherical lower end which protrudes from the bit head bottom.

Instead of each button 16 being set directly in a hole in the bit head, each has shrunk onto its cylindrical part a cylindrical tube or jacket 17 of steel, of lesser hardness than the tungsten carbide button. The jacket, being of greater resilience than the button will enable the assembly of the two to be force-fitted in a hole formed in the bit head with a minimum of likely damage during the fitting, and also during the operation of the bit.

One of the buttons, indicated at **16*a*, is located nearly centrally of the bit head, and the axis of this button is substantially parallel to that of the bit head; but each of the other buttons, displaced from the centre of the bit head bottom is, as shown in FIG. 5, set in a hole so formed that the axis 18 of the button is at an angle to a line 19 normal to the surface of the bit head bottom from which the hole is formed, the tilt of the button being in the direction of rotation of the bit, indicated by an arrow 20 in FIG. 5**.

Figure 4:
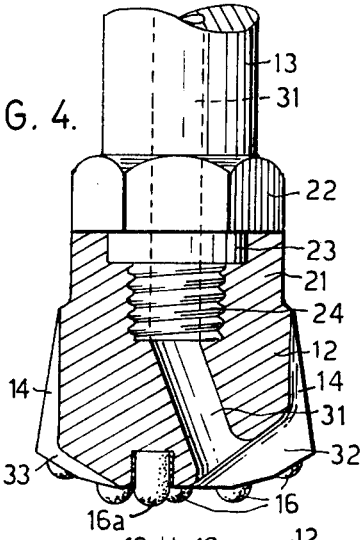
FIG. 4 is a partly sectioned view of the bit head and lower part of the anvil.

The upper part 21 of the bit head is of hexagonal cross-section, and a lower part 22 of the anvil 13 is of similar cross-section. As shown in FIG. 4, the anvil is made with a fairly shallow cylindrical boss 23 below its hexagonal-section part 22, and an integral coaxial tapered screw 24 extends below this boss. The bit head 12 is drilled and tapped from its upper end to receive the boss 23 and the screw 24 of the anvil, and when the anvil is fully engaged with the bit head, the hexagonal sections 22 and 21 are matched. Preferably, before assembly of the two parts, the bit head is heated and the anvil is chilled, so that the bit head is shrunk onto the anvil. Any necessary machining is done to ensure that the two hexagonal sections of the two parts are correctly matched.

The steel of the anvil 13 is preferably of a lesser degree of hardness, and of a high degree of resilience, than the bit head 12.

The matched hexagonal-section parts 21, 22 are closely but slidably engaged in a socket 25 of corresponding cross-sectional configuration formed in the lower part of the interior of the bit drive sub 11. Above this socket, the interior of the bit drive sub 11 is of round cross-section to receive closely but slidably a round-section intermediate part 26 of the anvil, above which an upper part 27 of the anvil is reduced in diameter, the top 28 of the anvil being increased to a diameter about equal to that of the intermediate part 26. A split retaining sleeve 29 about the reduced-diameter upper part 27 of the anvil is held in place within the housing 10 between an internal shoulder 30 formed by a reduced diameter part of the bore of the housing, and the upper end of the bit drive sub 11. This sleeve 29 limits the upward and downward movement of the bit in relation to the housing 10.

An air passage 31 through the bit is formed axially through the anvil 13 and obliquely through the lower part of the bit head 12, to communicate, by way of a radial groove 32 in the bit head bottom 15, with one of the vertical flutes 14. A diametrically opposed flute 14 has a further radial bottom groove 33 leading into it.

The upper end of the axial air passage 31 is enlarged in diameter to receive the lower end of an exhaust tube 33, formed above the anvil, with a multiplicity of perforations. The piston 34 of the hammer, pneumatically reciprocated within the housing, has an axial passage 35 in which the exhaust tube 33 is closely but slidably engaged.

When the hammer is in operation, the piston 34 is reciprocated pneumatically at high frequency, striking the top 28 of the anvil 13 with each down stroke, so that the buttons 16, **16*a* break up the rock in the bottom of the hole being formed. The housing 10 is rotated at the same time, and the slidable engagement of the matched hexagonal-section parts 21, 22 of the bit head 12 and anvil 13 in the hexagonal-section socket 25 of the bit drive sub 11 ensures that the bit is correspondingly rotated, all torsional stress in the bit being taken equally by the bit head 12 and anvil 13**. Consequently, there will be greatly reduced likelihood of the bit failing in use.

During operation of the hammer, air under pressure passes through the air passage 31 to the bottom of the bit to clean out the bore hole. The pressure applied to the hammer keeps the bit drive sub 11 close down on the bit head, but the housing 10 may from time to time be lifted in which case the operation of the piston 34 is interrupted and an increased flow of air under pressure passes through the air passage 31 for cleaning the bore hole. The slidable movement of the bit relative to the housing is so restricted that the hexagonal parts 21, 22 of the bit will not become disengaged from the bit drive sub socket 25.

The anvil 13 may, if preferred, be made integrally with the bit head 12, the hexagonal-section part of the bit which is slidable in the chamber 25 therefore being a single part of the bit. The anvil, above this hexagonal-section part, is not subjected to torsional stress and so the likelihood of its failing in use is materially reduced. By selective tempering techniques the anvil may be made less hard and more resilient than the bit head.

The part of the bit slidable in the chamber 25 of the bit drive sub may, of course, be of octagonal or any other suitable non-round cross-section, and slidably but non-rotatably engaged in a socket of corresponding cross-sectional configuration in the bit drive sub.

I claim:

1. A rock drilling bit for a percussion hammer, of the type having a rotatable tubular housing, a bit drive sub the upper region of which is secured to said housing for rotation therewith, said bit drive sub extending partially below said housing and being formed in the lower region thereof, from its bottom, with a socket having a non-round cross-section, said socket extending wholly within the part of the bit drive sub below said housing, a bit head and anvil extending upwardly from the bit head and slidable in said bit drive sub at the lower end of the hammer, wherein the upper part of the bit head engaged in said socket is of non-round cross-section adapted for slidable but non-rotatable movement in said socket.

2. The rock drilling bit of claim 1 wherein said bit head and said anvil are separate members, and wherein the bottom end of said anvil is of matching non-round cross-section to said upper part of said bit head and said socket so as to permit slidable but non-rotatable movement of said anvil in said socket.

3. The rock drilling bit according to claim 2 wherein the bottom end of the anvil is screw-threadedly engaged in the bit head, and the non-round cross-section part of the anvil is superimposed directly on the substantially similar and matching non-round cross-section part of the bit head.

4. A rock drilling bit according to claim 1 wherein there are provided a number of buttons each having a substantially cylindrical body secured in, and a substantially hermispherical end extending from the bottom of, the bit head, the axes of such buttons being inclined, from top to bottom, in the direction of rotation of the bit during operation of the pneumatic hammer.

5. A rock drilling bit according to claim 4 wherein the substantially cylindrical body of each of the said buttons is secured within a substantially cylindrical sleeve of metal of a lesser degree of harness than the button, the sleeve being force-fitted in a hole formed in the bit head.

* * * * *